US006691482B1

(12) United States Patent
Ault

(10) Patent No.: US 6,691,482 B1
(45) Date of Patent: Feb. 17, 2004

(54) DECKING

(75) Inventor: Robert L. Ault, Saltsburg, PA (US)

(73) Assignee: Epic Metals Corporation, Rankin, PA (US)

( * ) Notice: Subject to any disclaimer, the term of this patent is extended or adjusted under 35 U.S.C. 154(b) by 0 days.

(21) Appl. No.: 09/788,015

(22) Filed: Feb. 16, 2001

(51) Int. Cl.[7] ..... E04B 9/00; E04F 13/04

(52) U.S. Cl. ..... 52/450; 52/630; 52/783.14; 52/783.11; 52/783.19; 165/57; 454/368

(58) Field of Search ..... 52/450, 302.3, 52/198, 630, 783.14, 798.1, 799.1, 404.1, 783.11, 783.17, 783.19, 336, 537, 220.5; 165/57, 49; 454/366, 368

(56) References Cited

U.S. PATENT DOCUMENTS

| | | | | | |
|---|---|---|---|---|---|
| 1,833,456 | A | * | 11/1931 | Gant | 52/336 |
| 2,290,418 | A | | 7/1942 | Detrick | 45/138 |
| 2,339,865 | A | | 1/1944 | Larmour | 20/15 |
| 2,407,059 | A | * | 9/1946 | Crafton | 52/336 |
| 2,653,686 | A | | 9/1953 | Routt | 189/36 |
| 2,753,440 | A | | 7/1956 | Wakefield | 240/9 |
| 2,926,742 | A | | 3/1960 | Fischer | 181/33 |
| 3,016,998 | A | | 1/1962 | Buchmeier | 189/85 |
| 3,197,926 | A | * | 8/1965 | Shumaker | 52/145 |
| 3,225,504 | A | | 12/1965 | Gregoire | 52/509 |
| 3,234,700 | A | | 2/1966 | Creveling | 52/284 |
| 3,300,912 | A | | 1/1967 | Shumaker | 52/39 |
| 3,320,711 | A | | 5/1967 | Johnson | 52/483 |
| 3,339,334 | A | | 9/1967 | Rowan et al. | 52/731 |
| 3,466,832 | A | | 9/1969 | March | 52/536 |
| 3,499,673 | A | | 3/1970 | Soltysik et al. | 287/189.35 |
| 3,606,720 | A | | 9/1971 | Cookson | 52/714 |
| 3,892,099 | A | | 7/1975 | Worgan et al. | 52/479 |
| 4,063,395 | A | | 12/1977 | Stewart et al. | 52/309.5 |
| 4,346,544 | A | | 8/1982 | Larssen | 52/407 |
| 4,453,361 | A | | 6/1984 | Hulsey | 52/410 |
| 4,641,469 | A | | 2/1987 | Wood | 52/309.12 |
| 4,907,910 | A | * | 3/1990 | Teron | 405/132 |
| 5,016,411 | A | * | 5/1991 | Thorsnes | 52/220 |
| 5,050,360 | A | | 9/1991 | Gailey | 52/488 |
| 5,076,035 | A | | 12/1991 | Wright | 52/464 |
| 5,172,527 | A | * | 12/1992 | Ault | 52/145 |
| 5,259,157 | A | | 11/1993 | Ault | 52/144 |
| 5,611,184 | A | | 3/1997 | Felix et al. | 52/506.05 |
| 5,644,878 | A | | 7/1997 | Wehrmann | 52/287.1 |
| 5,692,345 | A | | 12/1997 | Mogaki et al. | 52/483.1 |
| 5,735,097 | A | | 4/1998 | Cheyne | 52/489.1 |
| 5,765,329 | A | * | 6/1998 | Huang | 52/302.3 |
| 5,842,316 | A | | 12/1998 | Keiper | 52/410 |
| 5,855,101 | A | | 1/1999 | Schulte et al. | 52/506.05 |
| 5,884,446 | A | | 3/1999 | Hageman | 52/408 |
| 5,904,011 | A | | 5/1999 | Biro | 52/177 |
| 6,151,854 | A | * | 11/2000 | Gutjahr | 52/385 |

FOREIGN PATENT DOCUMENTS

| | | | | |
|---|---|---|---|---|
| DE | 3904102 | * | 8/1990 | E04H/1/92 |
| GB | 2223522 | * | 8/1989 | E04B/1/80 |
| JP | 6-322897 | * | 5/1993 | E04D/1/30 |

OTHER PUBLICATIONS

Floor and Roof Panel Systems, Fenestra, Incorporated, 1960.

* cited by examiner

*Primary Examiner*—Carl D. Friedman
*Assistant Examiner*—Chi Q. Nguyen
(74) *Attorney, Agent, or Firm*—Webb Ziesenheim Logsdon Orkin & Hanson, P.C.

(57) ABSTRACT

Decking including a profiled panel having a plurality of open-faced spaced ribs attached to a plurality of respective connecting sections. Each of the ribs defines a recessed area. A panel is received within each of the recessed areas and attached to the profiled panel defining a cavity. Each cavity is defined by at least a portion of the rib and the panel, respectively. The cavity is adapted to receive a tip of a fastener passing through the rib. The fastener is used to secure roofing material to an upper surface of the decking when used to form a roof.

18 Claims, 3 Drawing Sheets

DECKING

BACKGROUND OF THE INVENTION

1. Field of the Invention

The present invention relates to metal roof and floor deck assemblies and more particularly to decking used for roofs that have roofing material attached to the decking through fasteners.

2. Description of the Prior Art

Convention centers, arenas, office buildings, and other major structures use metal decking to form a roof or ceiling. The metal decking can also be used for noise control. Roofing material may be attached to the decking. Typically, this roofing material may include many materials such as a metal/fabric laminate, an insulation layer, polystyrene, a fabric layer, and/or other materials. These roofing materials are then secured to the decking through a mechanical fastener, such as nails or screw type fasteners which are well known in the art. See, for example, U.S. Pat. No. 5,884,446.

Generally speaking, the decking includes a fluted profiled deck that includes a plurality of spaced apart ribs and flat sections. A recessed area is defined between the rib sections. Generally, during installation, tips of the mechanical fasteners pass through the flat sections and are exposed from a bottom surface of the profiled fluted deck. This can result in an unsightly appearance of the underside of the profiled fluted deck, which in many instances, forms a part of a ceiling.

Therefore, it is an object of the present invention to provide decking that has an improved appearance, such as a ceiling, after roofing material is attached thereto by mechanical fasteners.

SUMMARY OF THE INVENTION

The present invention is decking that includes a profiled panel having a base and at least one longitudinally-extending, open-faced rib extending from the base. Each open-faced rib defines a recessed area. A panel is received within each recessed area and is attached to the rib defining a-cavity. The cavity is defined by a portion of the rib and the panel, wherein the cavity is adapted to receive a tip of a fastener passing through the rib.

More specifically, the decking includes a profiled panel having a plurality of open-faced spaced ribs attached to a plurality of respective connecting sections. Each of the ribs defines a recessed area. A panel is received within each of the recessed areas and attached to the profiled panel defining a cavity. Each cavity is defined by at least a portion of the rib and the panel, respectively, wherein the panel is adapted to receive a tip of a fastener passing through the rib. Preferably, the panels and the profiled panel are made of metal and the panels are fastened to the profiled panel. Each of the ribs is defined by two spaced apart legs, wherein each leg is attached at an end to a rib base, and at another end to a respective connecting section. The connecting sections and the panels may be substantially flat. Each of the panels is fixedly attached to a respective rib defining a recessed area. The panels and the profiled panels may include a plurality of perforations for sound deadening qualities. Insulation material may be provided within the cavities defined by the panel and ribs.

Preferably, each of the panels is U-shaped and includes two panel legs expanding from a panel base. The panel legs are positioned adjacent to respective legs of the ribs so that the panel legs engage with the legs of the ribs. More specifically, the respective panel legs include one of male locking members and female locking members and respective legs of the ribs include the other of the male locking members and female locking members. The male locking members are adapted to engage with the female locking members. Preferably, the panels include the male locking members that are defined by longitudinally-extending portions extending along respective panel legs. Preferably, the respective legs of the ribs include female locking members that are defined by indentations that receive respective ones of the longitudinally-extending members. The bases of the ribs and the bases of the panels can include longitudinally-extending stiffeners.

The present invention is also roofing that incorporates the above-identified decking. The decking includes an upper surface and a lower surface. Roofing material is attached to the upper surface of the profiled panel. A plurality of fasteners having tips secure the roofing material to the profiled decking with the plurality of fasteners passing through the ribs and the tips of the plurality of fasteners positioned within the cavities of the decking so that the tips are not exposed from the lower surface of the decking.

The present invention is also a method for installing a roofing that includes the steps of: providing the above-identified decking; attaching the decking to a support structure; placing roofing material onto the upper surface of the decking; and securing the roofing material to the decking with a plurality of fasteners having tips, wherein the tips pass through the roofing material and the upper surface of the decking. The tips are contained within respective cavities and the tips do not extend below the lower surface of the decking.

The present invention is also a method of manufacturing decking that includes the steps of forming a profiled panel with a plurality of spaced ribs attached to a plurality of respective connecting sections, wherein each of the ribs defines a recessed area and attaching a panel within each of the recessed areas of the profiled panel to form a cavity, each cavity defined by at least a portion of the rib and the panel, respectively, wherein the cavity is adapted to receive a tip of a fastener passing through the rib.

DESCRIPTIONS OF THE PREFERRED EMBODIMENTS

Figure 1A:
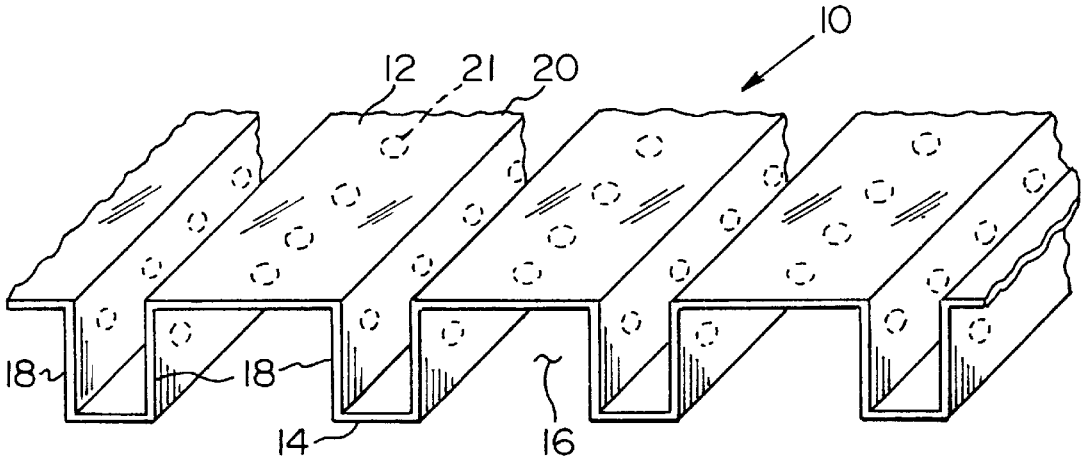
FIG. 1A PRIOR ART
FIG. 1A is a top perspective view of a portion of a prior art profiled decking.
Figure 1B:
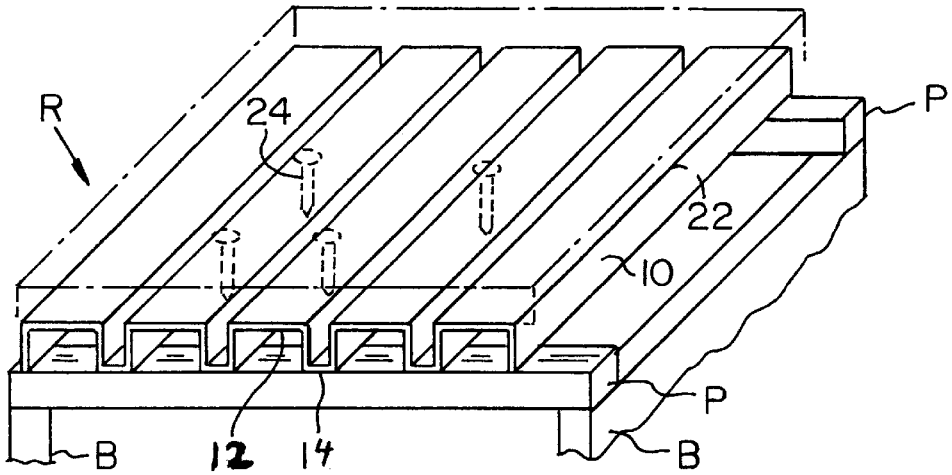
FIG. 1B PRIOR ART
FIG. 1B is a top perspective view of the profiled decking shown in FIG. 1A attached to purlins.

FIGS. 1A and 1B show a portion of a prior art profiled fluted decking or panel 10. Typically, the profiled fluted decking 10 is positioned on transversely extending purlins P or beams which are connected to a building superstructure B (such as load bearing walls) by conventional means recognized in the art. See, for example, U.S. Pat. No. 5,259,157, which is hereby incorporated by reference. The profiled fluted decking 10 includes a plurality of spaced apart open-faced, longitudinallyextending ribs 12. A plurality of longitudinally-extending flats or connecting portions or sections 14 is secured to the respective ribs 12. Preferably, the ribs 12 extend the complete width of the decking 10 and the connecting portions 14 are flat. Recessed areas 16 are defined by respective ribs 12. Each of the ribs 12 includes two spaced apart rib legs 18 having distal ends connected to a respective rib base 20 and opposite ends connected to respective connecting portions 14. Perforations 21, shown in phantom, may be provided for sound deadening properties.

Figure 2:
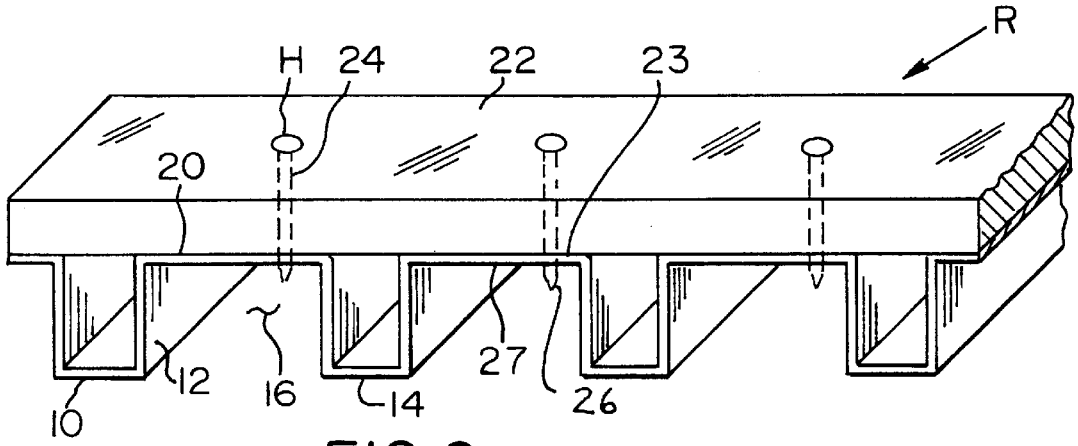
FIG. 2 PRIOR ART
FIG. 2 is a perspective view of the portion of the prior art profiled decking having insulation material attached thereto via mechanical fasteners with tips of the mechanical fasteners extending through a bottom surface of the profiled decking.

FIG. 2 shows a portion of roof R incorporating the profiled fluted decking 10. Specifically, the roof R includes the profiled fluted decking 10 having insulation material 22 positioned on a top surface or upper surface 23 of the profiled fluted deck 10 and resting on the rib bases 20 of ribs 12. Mechanical fasteners 24, such as nails or screws, pass through the insulation material or roofing 22 through the respective rib bases 20 of ribs 12 of the profiled fluted decking 10 so that tips 26 of the mechanical fasteners 24 pass through a bottom surface 27 of the profiled fluted decking 10. The mechanical fasteners 24 have heads H at an end opposite the tips 26. In many instances, the bottom surface or lower surface 27 forms a ceiling of a structure, whereby the exposed tips 26 provide an unsightly appearance for a ceiling. In other instances, a false ceiling may be secured to the connecting portions 14 to hide the exposed tips 26. However, the false ceiling is an extremely costly endeavor in both materials and labor.

Figure 3:
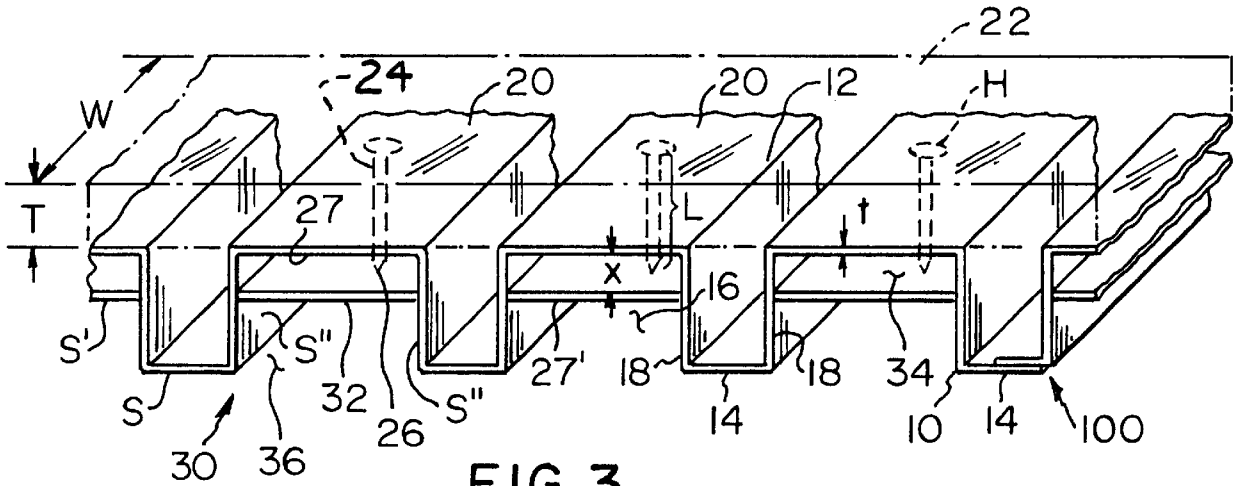
FIG. 3 is a top perspective view of a first embodiment of a portion of a profiled decking made in accordance with the present invention with insulation material and mechanical fasteners securing the insulation material to the decking shown in phantom.

FIG. 3 shows a first embodiment of a decking 30 made in accordance with the present invention. The decking 30 is similar to the profiled fluted decking 10, except for the below noted differences. Therefore, like reference numerals will be used for like elements. Decking 30 includes a plurality of panels or pans 32 secured to the ribs 12 and spaced a distance X away from the rib bases 20 and positioned within the recessed area 16. A cavity 34 is defined into which the exposed tips 26 of the mechanical fasteners 24 may be received after passing through a rib base 20. Preferably, the profiled fluted decking 10 and the panel or pan 32 are made of metal. In its simplest form, the panel or pan 32 is a flat plate that is fixedly attached, such as by welding or fastening, to the respective rib legs 18 spaced a distance X away from the rib bases 20 within the recessed area 16 so as to define the cavity 34 by a portion of respective rib legs 18, a rib base 20, and a respective panel or pan 32. In other words, each cavity 34 is defined by a portion of a respective rib 12 and a panel or pan 32. Preferably, each panel or pan 32 extends along the complete width W of the profiled fluted decking 10, like the ribs 12. The ribs 12 and the panels or pans 32 may have a plurality of perforations. Hence, after installation of the insulation material or roofing material 22 secured by the mechanical fasteners 24, the tips 26 are not exposed through a bottom surface 27' of the decking 30. The bottom surface 27' of the decking 30 is defined by bottom surfaces S of the connecting sections 14, bottom surfaces S' of the panel or pans 32, and outer surfaces S" of portions of rib legs 18 positioned below the panel or pans 32. Cavities 36 are defined between respective bottom surfaces S" of legs 18 and bottom surfaces S' of panels or pans 32. Respective panels or pans 32 are spaced a vertical distance X from the rib bases 20, whereby $L \leqq T+X+t$, where L is the maximum length of the fasteners 24; T is the thickness of the roofing material 22; and t is the thickness of the rib base 20.

As shown in FIG. 3, each cavity or first cavity 34 is defined by a portion of rib 12 and a first surface 39 of the panel 32. Each cavity 36 is open-faced and defined by the bottom surface or second surface S' of the panel 32 and a portion of the rib 12, wherein the first cavity 34 is adapted to receive the tip 26 of the respective fastener 24.

Figure 4:
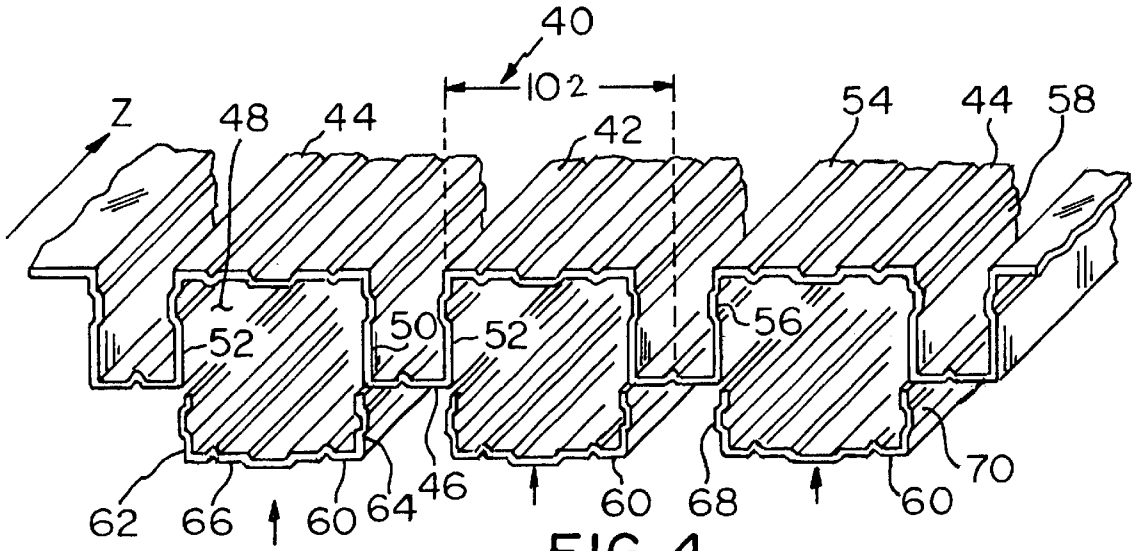
FIG. 4 is an exploded perspective view of a second embodiment of a portion of a profiled decking made in accordance with the present invention.
Figure 5:
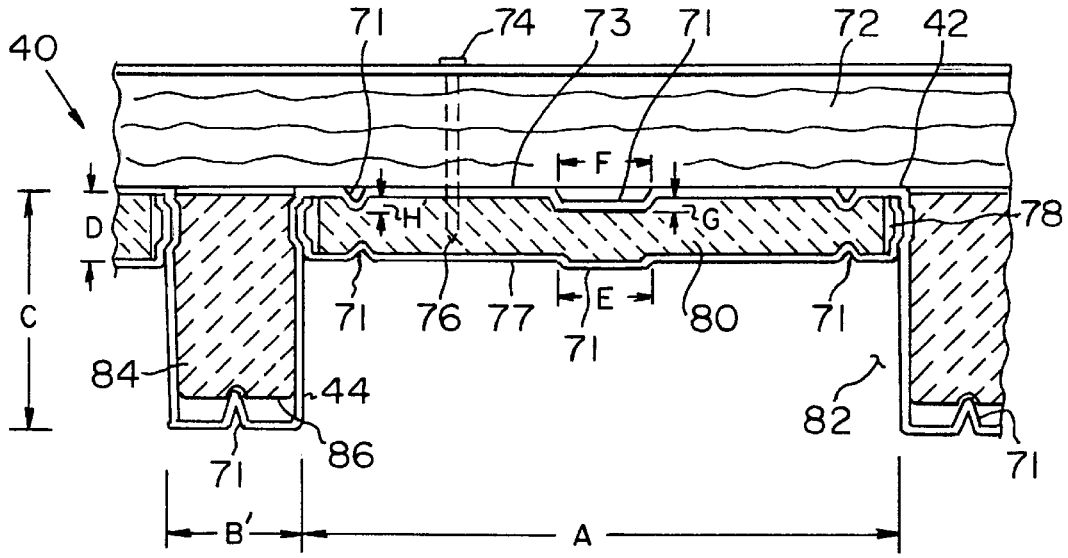
FIG. 5 is an elevational view of the profiled decking shown in FIG. 4 having fasteners securing insulation material thereto.
Figure 6:
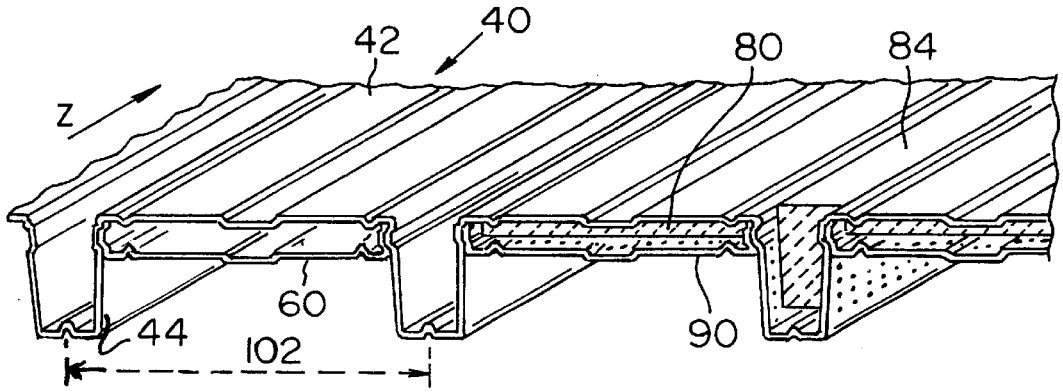
FIG. 6 is a perspective view of the profiled decking shown in FIG. 4 made in accordance with the present invention.
Figure 3:
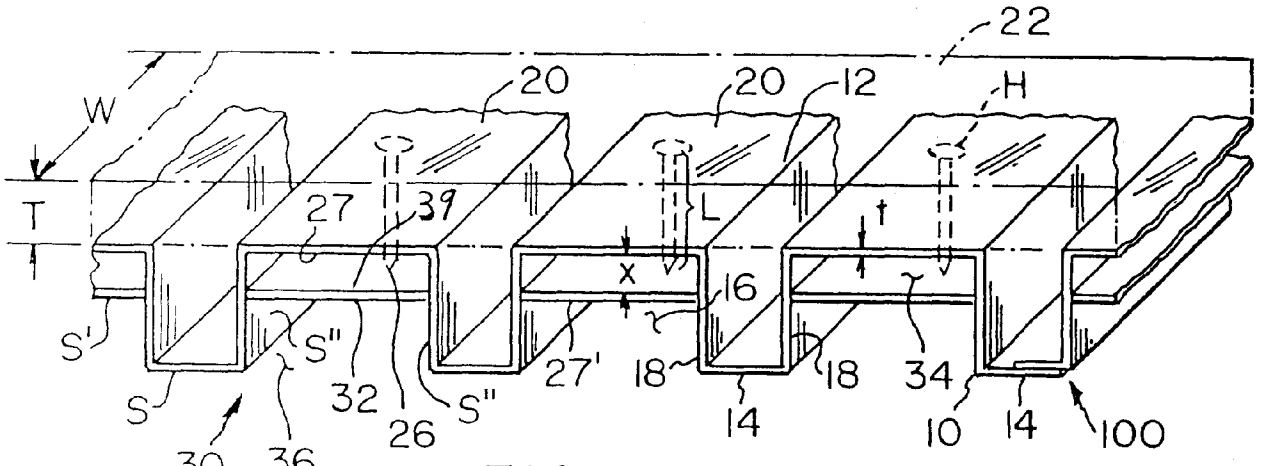
Figure 4:
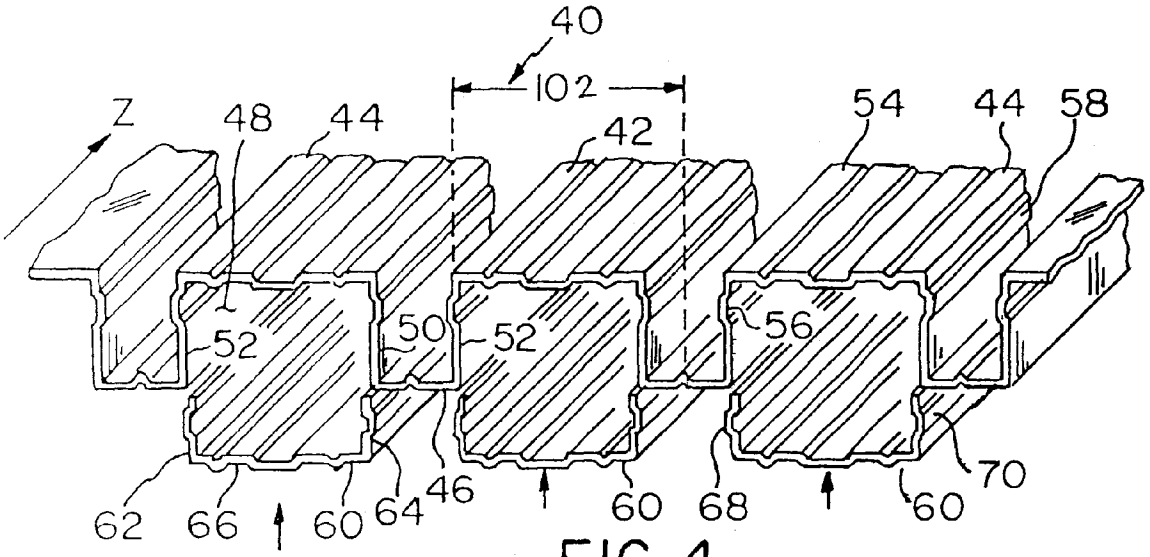

FIGS. 4–6 show a second embodiment of decking 40 made in accordance with the present invention. The decking 40 includes a profiled deck 42 that includes a plurality of spaced open-faced, longitudinally-extending ribs 44 separated by longitudinally-extending flats or connecting portions 46. A recessed area 48 is defined by rib legs 50 and 52 of respective ribs 44 and a rib base 54. Respective rib legs 50 and 52 are connected to a rib base 54 at a distal end and to respective connecting portions 46 at opposite ends. Each rib leg 50 and 52 includes a respective longitudinally-extending indentation or female locking members 56 and 58. A plurality of U-shaped panels or pans 60 are received in respective recessed areas 48. Each panel or pan 60 includes spaced apart panel legs 62 and 64 connected to a panel base portion 66. Extending members or male locking members 68 and 70 extend from legs 62 and 64, respectively. The extending members 68 and 70 are adapted to be received and engaged by respective indentations or female locking members 56 and 58 so as to mechanically secure the panel or pan 60 to the profiled deck 42 to form the decking 40. Preferably, the panel or pan 60 is snapped into place with the male locking members 68 and 70 coacting with the female locking members 56 and 58 so that the panel legs 62 and 64 are positioned adjacent to and engaged with respective rib legs 50 and 52. Preferably, the panel or pan 60 and profiled deck 42 are made of metal and the panel or pan 60 may be additionally tack welded or other mechanically fastened to the profiled deck 42. Alternatively, the female locking members 56 and 58 may be formed on the panel or pan 60 and the male locking members 68 and 70 may be formed on the profiled deck 42. Any other type of mechanically-attaching mechanisms may be used to secure the panel or pan 60 to the profiled deck 42.

The decking 40 also includes a plurality of longitudinally-extending stiffener members or stiffeners 71 on both the profiled deck 42 and the panel or pan 60. The stiffening members 71 provide additional stiffness to bending in the Z direction.

Referring to FIG. 5, in operation, the decking 40 or a plurality of decking 40 is laid side-by-side, is attached to beams P (shown in FIG. 1B) of a support structure B (shown in FIG. 1B), insulation material or other roofing material 72 is laid or placed on an upper surface or top surface 73 of the profiled deck 42. A plurality of fasteners 74 pass through the insulation material 72 and tips 76 of the fasteners 74 are received within a cavity area 78. The fasteners 74 secure the roofing material 72 to the profiled decks 42. As can be seen in FIG. 6, the fastener tips 76 do not extend through a bottom surface 77 of the decking 40 or through panel or pan 60 and the tips 76 are hidden from view and not exposed from the bottom surface 77 of the decking 40. Insulation 80, be it sound insulation or thermal insulation, may be received within the cavity area 78 to provide additional sound insulation and/or thermal insulation to the decking 40. Further, insulation blocks 84 may be provided within recesses 86 defined by the respective ribs 44. Further, the stiffening members 71 may provide a support onto which the insulation blocks 84 rest. Referring to FIG. 6, the decking 40 may include perforations 90, insulation 80, and insulation blocks 84 depending on the application.

The present invention solves a problem that has plagued profiled roof decking in the past, namely, having unsightly tips of mechanical fasteners exposed from a bottom surface of the profiled decking which forms a portion of the ceiling. Prior to the present invention, the only solution to this problem was doing nothing or attaching a false ceiling to a bottom surface of the deck to hide the appearance of the fastener tips. The present invention solves this problem and hides the tips of the fasteners in a cavity positioned below the connecting portions or flats of the decking, which creates a pleasing appearance of the profiled decking which forms the ceiling.

Decking 30 and 40 can be made through the following process. Flat sheets of steel can be passed through various dies to result in a profiled deck 42 or decking 10. Generally speaking, each profiled deck 42 includes a plurality of ribs 44 spaced apart by a connecting portion 46. During installation, adjacent decking can be placed next to each other via the end ribs of adjacent sections. Alternatively, the end ribs of each decking sections can be formed having end connecting portions 100, shown in FIG. 3, adapted to be mated with each other, also shown in U.S. Pat. No. 5,172,527, which is hereby incorporated by reference. Also, each profiled deck can only include one rib profile having a width 102, shown in FIGS. 4 and 6 and having end sections such as shown in U.S. Pat. No. 5,127,527, which can be joined together to form a panel having a plurality of ribs. Pans or panels 60 are formed from sheet steel and snapped into place with the respective ribs 44 as previously disclosed. Insulation 80 may be received by the pans or panels 60 prior to assembly. The pans or panels 60 may also be fastened to the profiled deck 42. An example of a decking made in accordance with the present invention, has the following dimensions as referred to in FIG. 5:

A≅15"

B'=3"

C=4½–7½"

D=2"

E=2¼"

F=2½"

G=½

H'=⅜

The decking 40 then may be installed on site as previously discussed. Preferably, the profiled deck is made of 18-14 gauge steel and the panels 60 are made of 20 gauge steel.

Having described the presently preferred embodiments of our invention, it is to be understood that it may otherwise be embodied within the scope of the appended claims.

I claim:

1. Decking comprising:

a profiled panel having a plurality of open-faced spaced ribs attached to a plurality of respective connecting sections, wherein each of said ribs defines a recessed area; and a multi-sided panel having a first surface and a second surface received within each of said recessed areas, said multi-sided panel including two spaced apart legs, said multi-sided panel attached to said profiled panel and extending between rib legs of said rib and defining a closed first cavity and a second cavity, each first cavity defined by a portion of said rib legs and said first surface of said panel, said legs of said multi-sided panel extending into the first cavity respectively, wherein the first cavity is adapted to receive a tip of a fastener passing through said rib with the tip contained within said first cavity and each second cavity is open-faced and defined by said second surface of said panel and a portion of said rib legs.

2. Decking as claimed in claim 1, wherein each of said ribs is defined by two spaced apart legs, each leg attached at an end to a rib base and at another end to a respective connecting section.

3. Decking as claimed in claim 2, wherein said connecting sections are substantially flat.

4. Decking as claimed in claim 1, wherein each of said panels is fixedly attached to a respective rib defining said recessed area.

5. Decking as claimed in claim 1, wherein each of said panels is flat.

6. Decking comprising:

a profiled panel having a plurality of open-faced spaced ribs attached to a plurality of respective connecting sections, wherein each of said ribs defines a recessed area; and a panel having a first surface and a second surface received within each of said recessed areas, said panel attached to said profiled panel and extending between rib legs of said rib and defining a first cavity and a second cavity, each first cavity defined by a portion of said rib legs and said first surface of said panel, respectively, wherein the first cavity is adapted to receive a tip of a fastener passing through said rib and each second cavity is open-faced and defined by said second surface of said panel and a portion of said rib legs, wherein at least one of said panel and said profiled panel includes a plurality of perforations.

7. Decking comprising:

a profiled panel having a plurality of open-faced spaced ribs attached to a plurality of respective connecting sections, wherein each of said ribs defines a recessed area; and a panel having a first surface and a second surface received within each of said recessed areas, said panel attached to said profiled panel and extending between rib legs of said rib and defining a first cavity and a second cavity, each first cavity defined by a portion of said rib legs and said first surface of said panel, respectively, wherein the first cavity is adapted to receive a tip of a fastener passing through said rib and each second cavity is open-faced and defined by said second surface of said panel and a portion of said rib legs, wherein the decking further comprises insulation material received within the cavity.

8. Decking comprising:

a profiled panel having a plurality of open-faced spaced ribs attached to a plurality of respective connecting sections, wherein each of said ribs defines a recessed area; and a panel having a first surface and a second surface received within each of said recessed areas, said panel attached to said profiled panel and extending between rib legs of said rib and defining a first cavity and a second cavity, each first cavity defined by a portion of said rib legs and said first surface of said panel, respectively, wherein the first cavity is adapted to receive a tip of a fastener passing through said rib and each second cavity is open-faced and defined by said second surface of said panel and a portion of said rib legs, wherein each of said ribs is defined by two spaced apart legs, each leg attached at an end to a rib base and at another end to a respective connecting section and wherein said panels is U-shaped.

9. Decking as claimed in claim 8, wherein each of said panel comprises two panel legs extending from a panel base, said panel legs positioned adjacent to respective legs of said ribs.

10. Decking as claimed in claim 9, wherein said panel legs engage with said legs of said ribs.

11. Decking as claimed in claim 10, wherein said respective panel legs include one of male locking members and female locking members and respective legs of said ribs include other of said male locking members and female locking members, said male locking members adapted to engage with said female locking members.

12. Decking as claimed in claim 11, wherein said panels include male locking members that include longitudinally-extending portions extending along respective panel legs and said respective legs of said ribs include female locking members that are defined by indentations that receive respective ones of said longitudinally-extending members.

13. Decking as claimed in claim 12, wherein said bases of said ribs and said bases of said panels include longitudinally-extending stiffeners.

14. Decking as claimed in claim 12, wherein said panels and said profiled panel comprise metal and said panels are fastened to said profiled panel.

15. Roofing comprising:

decking, comprising a profiled panel having a plurality of open-faced spaced ribs attached to a plurality of respective connecting sections, wherein each of said ribs defines a recessed area;

a panel having a first surface and a second surface received within each of said recessed areas, said panel attached to said profiled panel and extending between rib legs of said rib and defining a first cavity and a second cavity, each first cavity defined by at least a portion of said rib legs and said first surface of said panel, respectively, wherein the first cavity is adapted to receive a tip of a fastener passing through said rib section, said decking having an upper surface and a lower surface and each second cavity is open-faced and defined by said second surface of said panel and a portion of said rib legs;

roofing material attached to said upper surface of said decking; and a plurality of fasteners having tips, said plurality of fasteners securing said roofing material to said profiled decking with said plurality of fasteners passing through said ribs and said tips of said plurality fasteners positioned within the first cavities of said decking so that the tips are not exposed from a lower surface of the decking.

16. A method for installing a roof comprising the steps of:

(a) providing decking having a profiled panel with a plurality of open-faced spaced ribs attached to a plurality of respective connecting sections, wherein each of said ribs defines a recessed area and a panel having a first surface and a second surface received within each of said recessed areas, said panel attached to said profiled panel and extending between rib legs of said rib and defining a first cavity and a second cavity, each first cavity defined by at least a portion of said rib legs and said first surface of said panel, respectively, wherein the first cavity is adapted to receive a tip of a fastener passing through said rib and each second cavity is open-faced and defined by said second surface of said panel and a portion of said rib legs, said decking having an upper surface and a lower surface;

(b) attaching said decking to a support structure;

(c) placing roofing material onto the upper surface of said decking; and (d) securing said roofing material to said decking with a plurality of fasteners having tips, wherein said tips pass through said roofing material and an upper surface of said decking, said tips are contained within respective first cavities and said tips do not extend into the second cavities.

17. A method of manufacturing decking comprising the steps of:

forming a profiled panel with a plurality of open-faced spaced ribs attached to a plurality of respective connecting sections, wherein each of said ribs defines a recessed area; and attaching a multi-sided panel having a first surface and a second surface within each of the recessed areas of said profiled panel, said multi-sided panel including two spaced apart legs to extend between rib legs of said rib and form a closed first cavity and a second cavity, each first cavity defined by at least a portion of said rib legs and first surface of said multi-sided panel, said legs of said multi-sided panel extending into the first cavity respectively, wherein the first cavity is adapted to receive a tip of a fastener passing through said rib with the tip contained within the first cavity and each second cavity is open-faced and defined by said second surface of said panel and a portion of said rib legs.

18. Decking comprising:

a profiled panel having a base and at least one longitudinally-extending, open-faced rib extending from said base, wherein each of said at least one open-faced spaced rib defines a recessed area; and a panel having a first surface and a second surface received within each recessed area, said panel attached to said rib and extending between rib legs of said rib and defining a first cavity and a second cavity, the first cavity defined by a portion of said rib legs and said first surface of said panel, wherein the first cavity is adapted to receive a tip of a fastener passing through said rib and each second cavity is open-faced and defined by said second surface of said panel and a portion of said rib legs.

* * * * *

UNITED STATES PATENT AND TRADEMARK OFFICE

CERTIFICATE OF CORRECTION

PATENT NO. : 6,691,482 B1
DATED : February 17, 2004
INVENTOR(S) : Robert L. Ault It is certified that error appears in the above-identified patent and that said Letters Patent is hereby corrected as shown below:

Drawings,
Insert replacement Sheet 2 of 3.
New FIG. 3 added reference numeral -- 39 --.

Signed and Sealed this

Seventeenth Day of August, 2004

JON W. DUDAS
*Acting Director of the United States Patent and Trademark Office*